US008678206B2

(12) United States Patent
Kubiniec

(10) Patent No.: US 8,678,206 B2
(45) Date of Patent: Mar. 25, 2014

(54) SYSTEM FOR STORAGE AND TRANSPORT OF WEAPONS

(76) Inventor: Thomas Kubiniec, Cazenovia, NY (US)

( * ) Notice: Subject to any disclaimer, the term of this patent is extended or adjusted under 35 U.S.C. 154(b) by 113 days.

(21) Appl. No.: 13/212,584

(22) Filed: Aug. 18, 2011

(65) Prior Publication Data

US 2012/0193254 A1 Aug. 2, 2012

Related U.S. Application Data

(60) Provisional application No. 61/437,462, filed on Jan. 28, 2011.

(51) Int. Cl.
*B60R 7/14* (2006.01)

(52) U.S. Cl.
USPC ..... 211/64

(58) Field of Classification Search
USPC ..... 211/64, 65, 66, 87.01, 86.01, 113; 42/85, 94; 224/250, 459, 460, 42.39, 224/567, 568, 913; 24/3.13, 16 PB; 248/201, 693; 206/317
See application file for complete search history.

(56) References Cited

U.S. PATENT DOCUMENTS 554,252 A * 2/1896 Falk ..... 211/64
1,202,588 A * 10/1916 Roberts ..... 312/237
1,951,255 A * 3/1934 Parker ..... 211/64
2,783,896 A * 3/1957 Agostini et al. ..... 211/64
2,958,422 A * 11/1960 Caloiero et al. ..... 211/4
2,987,285 A * 6/1961 Andrews ..... 248/113
4,113,107 A * 9/1978 Jaeger ..... 211/4
4,132,315 A * 1/1979 Young ..... 211/4
4,141,452 A * 2/1979 Martin et al. ..... 211/70.6
4,174,042 A * 11/1979 Fair ..... 211/8
4,461,385 A * 7/1984 Clouser ..... 211/4
4,776,471 A * 10/1988 Elkins ..... 211/64
4,936,531 A * 6/1990 Bauser ..... 224/42.11
4,982,522 A * 1/1991 Norton ..... 42/85
4,986,427 A * 1/1991 Law et al. ..... 211/64
5,062,184 A * 11/1991 Rowland ..... 24/16 PB
5,078,279 A * 1/1992 Hancock et al. ..... 211/64
5,222,701 A * 6/1993 Rowland ..... 248/74.3
5,265,950 A * 11/1993 Atkinson ..... 312/216
5,524,772 A * 6/1996 Simmons ..... 211/4

(Continued)

OTHER PUBLICATIONS

Spacesaver, Installation Instructions for Universal Weapons Rack, pp. 1-32, Jun. 2010, www.spacesaver.com/Universal_Weapons_Rack.htm.

(Continued)

*Primary Examiner* — Jennifer E Novosad
(74) *Attorney, Agent, or Firm* — Harris Beach PLLC

(57) ABSTRACT

A system for safely storing and/or transporting one or more weapons inside a container. The system includes an upper saddle and a lower saddle configured to be attached to a container having means for saddle attachment such as brackets. The upper saddle has an inset configured to receive any of a plurality of weapon parts including at least a barrel, a magazine well, and a "picatinney" rail, and the lower saddle has a concave surface configured to receive the stock or other weapon part. Preferably, the system includes flexible cords such as lanyards or shock cords for releasably binding a weapon to the saddle system. The saddle system may be configured in multiple ways to allow for storage of a single weapon inside a container, multiple weapons of the same type within a single container, or different types of weapons having different sizes and shapes within a single container.

18 Claims, 10 Drawing Sheets

(56) References Cited

U.S. PATENT DOCUMENTS

| | | | | |
|---|---|---|---|---|
| 5,806,691 | A * | 9/1998 | Nelson | 211/70.5 |
| 5,979,846 | A * | 11/1999 | Fluhr | 248/200 |
| 6,129,252 | A * | 10/2000 | Jackson et al. | 224/406 |
| 6,427,497 | B1 * | 8/2002 | Mossberg et al. | 70/18 |
| 6,929,233 | B2 * | 8/2005 | Andin et al. | 249/109 |
| 6,935,065 | B1 * | 8/2005 | Oliver | 42/94 |
| 6,986,446 | B2 * | 1/2006 | Murray et al. | 224/275 |
| 7,267,353 | B1 * | 9/2007 | Mayhew | 280/293 |
| 7,467,719 | B2 * | 12/2008 | Crowell et al. | 211/64 |
| 7,478,892 | B2 * | 1/2009 | Punzel et al. | 312/322 |
| D611,558 | S * | 3/2010 | Freeman | D22/108 |
| 7,770,740 | B2 * | 8/2010 | Punzel et al. | 211/64 |
| 8,444,034 | B2 * | 5/2013 | Bennett | 224/405 |
| 2005/0133473 | A1 * | 6/2005 | Lesperance | 211/64 |
| 2006/0113341 | A1 * | 6/2006 | Murray et al. | 224/275 |
| 2006/0288625 | A1 * | 12/2006 | Williams | 42/70.11 |
| 2007/0170129 | A1 * | 7/2007 | Punzel et al. | 211/64 |
| 2011/0168649 | A1 * | 7/2011 | Stolz | 211/4 |
| 2012/0228243 | A1 * | 9/2012 | Crigger et al. | 211/7 |

OTHER PUBLICATIONS

Marvel, Design Drawing for Part No. WRBSXW, Sheet 1 of 1, Apr. 2007,www.universalweaponracks.com/pdfs/new/WRBSXW.PDF.

Marvel, Design Drawing for Part No. MWRM4/16/500M249, Sheet 1 of 1,Jul. 2008, www.universalweaponracks.com/pdfs/new/MWRM4-16-500M249a.PDF.

US Army, PS Magazine PS 639, Feb. 2006, pp. 1-2, https://www.logsa.army.mil/psmag/pshome.cfm.

* cited by examiner

SYSTEM FOR STORAGE AND TRANSPORT OF WEAPONS

RELATIONSHIP TO OTHER APPLICATIONS AND PATENTS

The present application draws priority from a pending Provisional U.S. Patent application Ser. No. 61/437,462, filed Jan. 28, 2011, the entire contents of which are incorporated herein by this reference.

FIELD OF THE INVENTION

The present invention relates to apparatus for storing and/or transporting firearms; more particularly to a system for storing and/or transporting long guns such as rifles, shotguns, machine guns, rocket launchers, and the like; and most particularly to a compact system for safely storing and transporting a plurality of disparate weapons in a single container.

BACKGROUND OF THE INVENTION

As used herein, "weapon" refers to a hand-held gun, and generally to a long gun having a stock for generally gripping the weapon and a barrel for discharging a projectile. Such a weapon may be broken down into any of several component parts for storage and/or transport in a system in accordance with the present invention.

The military, police forces, and security companies use various types of weapons, including but not limited to handguns, shotguns, semi-automatic rifles, assault rifles, machine guns, and grenade launchers. Storage of these weapons may include placing the weapons within a container, such as a rack, cart, cabinet, or case, referred to herein generally as "containers". Such containers may be transported from one location to another with the weapons contained therein.

In a static environment, stored weapons may shift in place due to weight and shape of the stored weapons. In a moving environment, such as during transport or when racks or cabinets are placed on a high density mobile aisle storage system, movement can cause the weapons to shift and become displaced. Therefore, it is desirable that weapons are safely secured within a container to prevent damage to the weapons, to their surroundings, and to humans; and to facilitate storage and transport of large numbers of disparate weapons.

Because the military, police forces, and security companies may have need for many different types of weapons at a single time, it is highly desirable that the various types of weapons be securely stored and easily available within a single container.

What is needed is a system for storage and transport of weapons wherein various types of weapons can be securely stored within a single container.

It is a primary object of the invention to safely and securely store and transport weapons.

SUMMARY OF THE INVENTION

The present invention comprises a system for safely storing and/or transporting one or more weapons inside a container. The system includes an upper saddle and a lower saddle configured to be attached to a container having means for saddle attachment such as brackets, louvered panels, and/or slotted shelves. In at least one embodiment, an upper saddle has an inset configured to receive any one of a plurality of weapon parts including at least a barrel, a magazine well, and an attached rail such as a "picatinney" rail, and a lower saddle has a concave surface configured to receive the stock or other weapon part. Preferably, the system includes flexible elastic cords such as lanyards or shock cords for releasably binding a weapon to the saddle system.

The saddle system may be configured in multiple ways to allow for storage of a single weapon inside a container, multiple weapons of the same type within a container, or different types of weapons having different sizes and shapes within a container. Some of these multiple configurations may include a plurality of upper and/or lower saddles.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices may be shown schematically to simplify the drawings.

Figure 1:
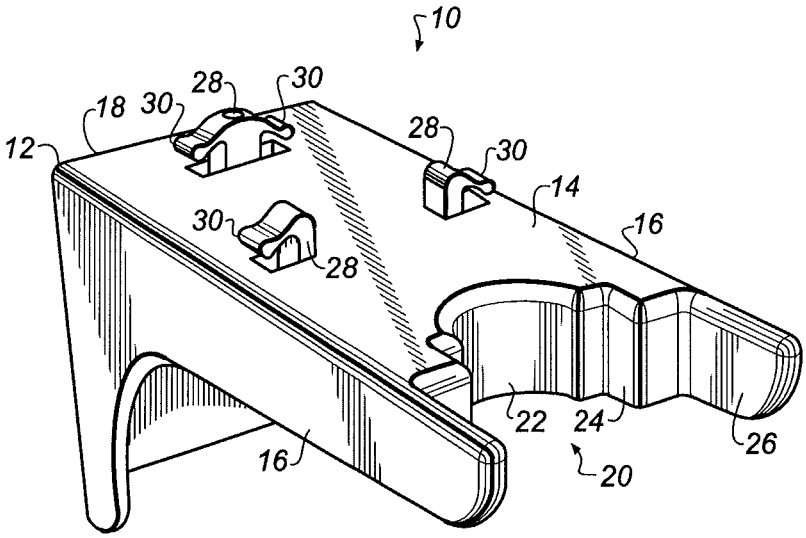
FIG. 1 is an isometric view of a preferred embodiment of an upper saddle in accordance with the present invention.
Figure 2:
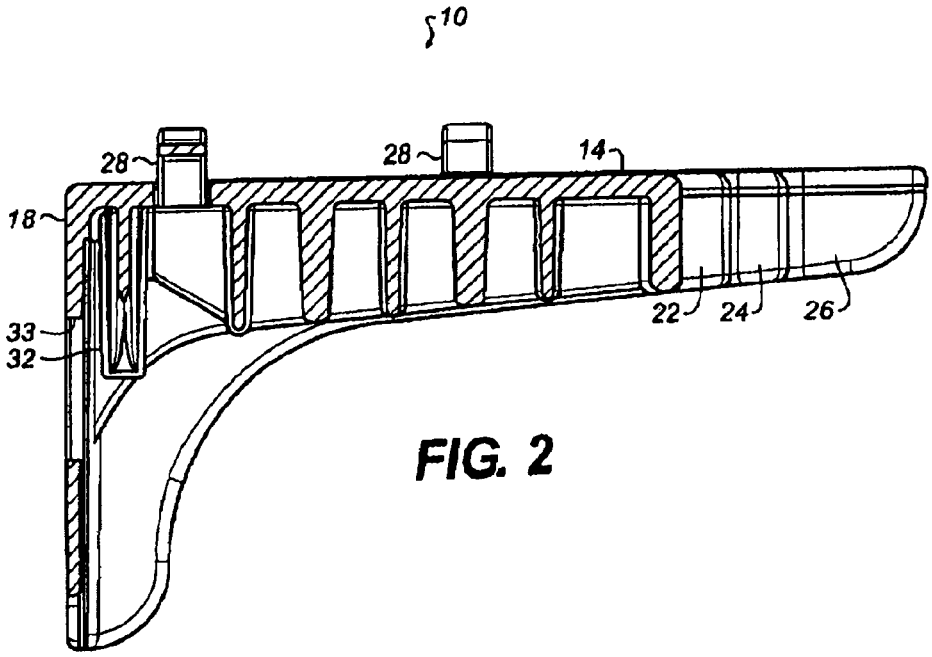
FIG. 2 is an elevational cross-sectional view the upper saddle shown in FIG. 1.
Figure 2A:
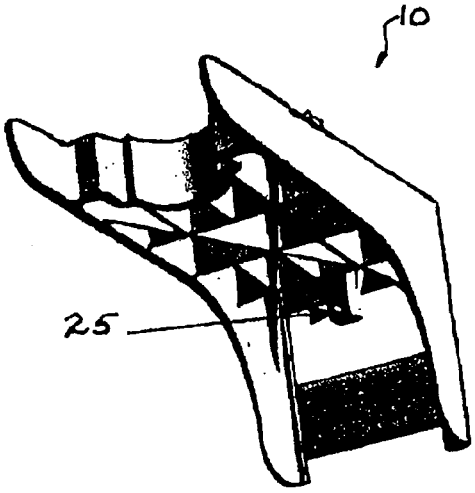
FIG. 2A is an isometric view from below of the upper saddle shown in FIG. 1.

Referring to FIGS. 1 through 2A, an upper saddle 10 in accordance with the present comprises a saddle body 12 having an upper surface 14, parallel side surfaces 16, and a back surface 18. Upper saddle 10 is preferably formed by injection molding of a thermosetting plastic such nylon, acrylonitrile butadiene styrene, or polytetrafluoroethylene, but may be formed by known means of any convenient plastic, wood, or metal. In yet other embodiments, upper saddle 10 may be constructed from multiple pieces and joined together by methods known by those of skill in the art.

Upper saddle 10 is configured to receive and support alternately the barrel of a weapon, a rail attached to the weapon, and/or a magazine well of a weapon, as further described below. A general inset 20 interrupts the outer ends of top surface 14 and side walls 16. General inset 20 preferably comprises at least a semi-cylindrical inner inset 22, a first rectangular intermediate inset 24, and a second rectangular outer inset 26, each inset being intended to receive alternatively a different component of a weapon. Outer inset 26 has a molded first and second rail shoulder spaced to fit a picatinny rail of a weapon. Intermediate inset 24 has a molded first and second magazine shoulder spaced to fit a magazine well of a weapon. Inner inset 22 has a molded barrel shoulder formed to fit a barrel of a weapon.

Preferably, upper surface 14 supports at least one, and preferably three, upwardly-extending cleats 28, each having one or more outwardly-extending tangs 30 for receiving a lanyard (not shown) used in securing a weapon (not shown) to upper saddle 10. Back surface 18 includes a recess 32 for receiving a bracket of a container back wall 76 as described below with respect to FIG. 5 to secure upper saddle 10 to wall 76. Recess 32 includes a flange 33, preferably sized to fit standard industry louvered walls of weapons containers, for attaching upper saddle 10 to a container.

In a further embodiment (FIG. 2A) a molded nut 25 may extend from the bottom surface of upper saddle 10 to allow for positive lock down of upper saddle 10 to a container wall 76 using a screw. In one embodiment, molded nut 25 is a "Pem" nut; in other embodiments, other types of molded nuts or fastener components may be used, as will be understood by those of ordinary skill in the art.

Other embodiments of upper saddle 10 may utilize different sizes and shapes so long as an insert permits secure placement of a weapon therein.

Figure 3:
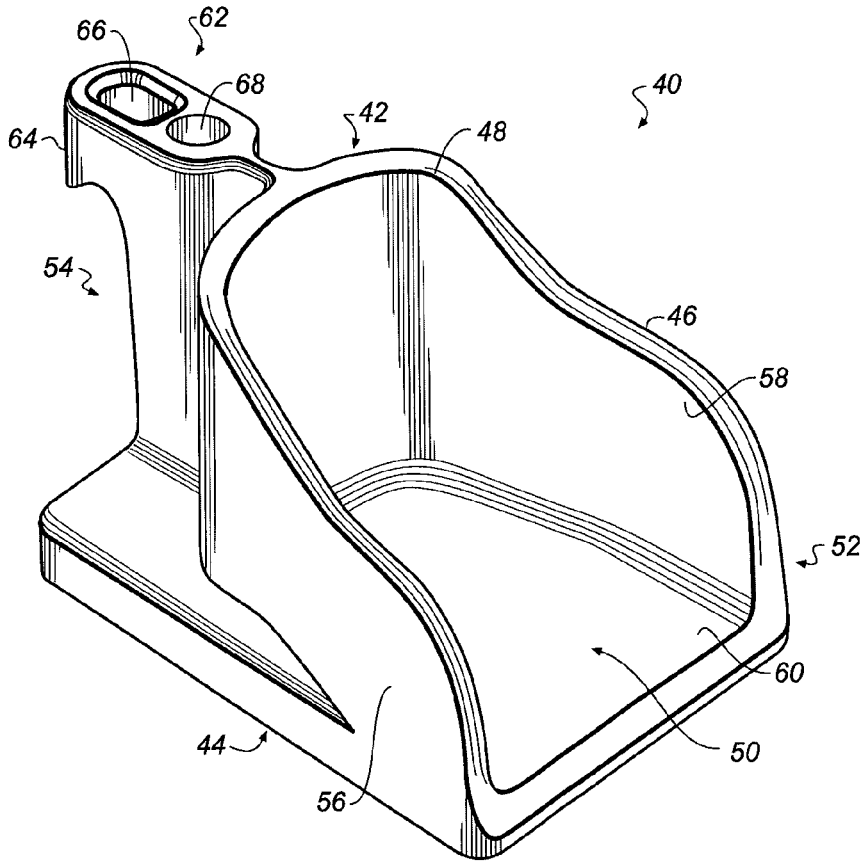
FIG. 3 is an isometric view of a preferred embodiment of a lower saddle in accordance with the present invention.
Figure 4:
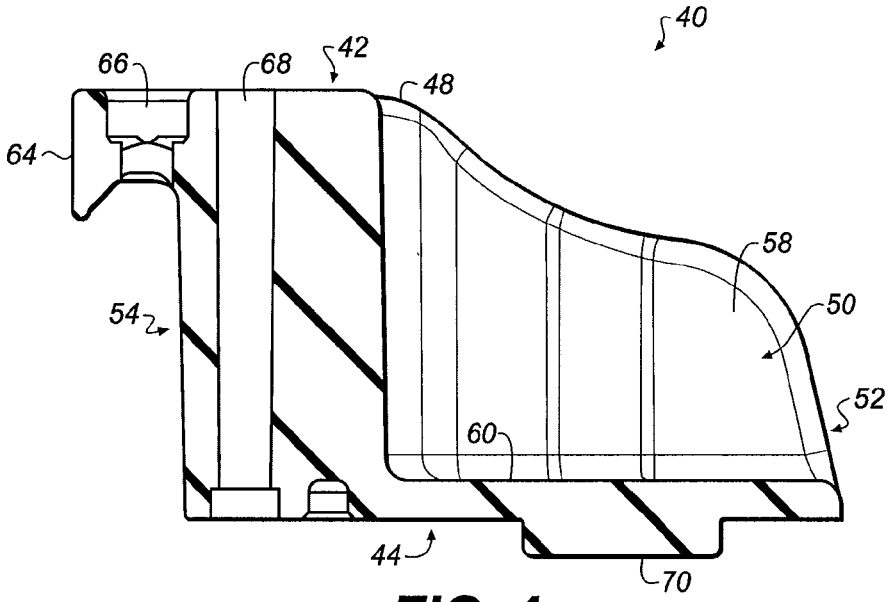
FIG. 4 is an elevational cross-sectional view of the lower saddle shown in FIG. 3.

Referring now to FIGS. 3 and 4, a lower saddle 40 in accordance with the present invention is preferably formed by a process and of materials similar to those of upper saddle 10 as described above. Lower saddle 40 has a top side 42 and a bottom side 44. In use, bottom side 44 rests on a surface of a container (not shown) used to store weapons. Weapons stocks or other features rest on lower saddle 40, and the weapon preferably is secured to lower saddle 40 using known tie-down methods, as described below.

Lower saddle 40 comprises a raised shoulder 46 generally defined by a ridge 48 that creates a concave portion 50 facing first end 52. Ridge 48 begins at or near first end 52, elevates from bottom side 44 to top side 42, extends toward second end 54 and curves inwardly toward the center of lower saddle 40, and curves back toward first end 52 and decreases elevation toward bottom side 44.

Raised shoulder 46 has an outer surface 56 and an inner surface 58. Inner surface 58 extends from the ridge 48 toward the bottom side 44 and contacts bed 60 which is open at first end 52. Inner surface 58 and bed 60 form a concave profile, shaped to fit the stock of military weapons, or alternatively other weapon parts, to securely store a weapon or weapon component within a container.

Figure 8:
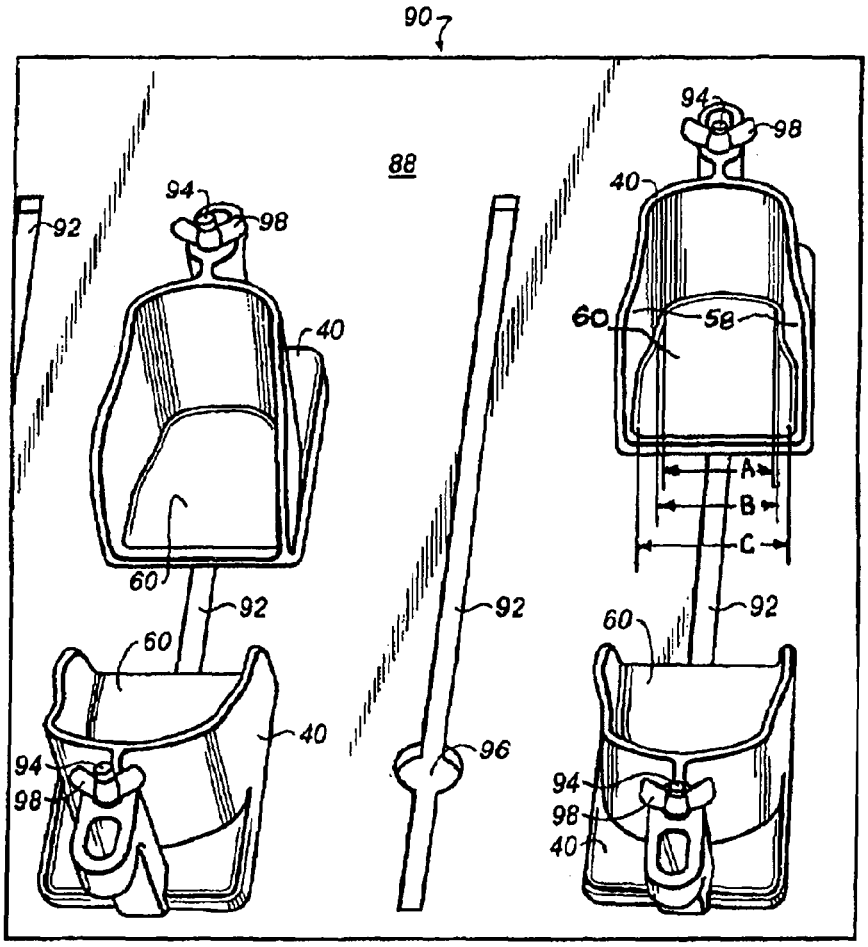
FIG. 8 is an isometric view showing a plurality of lower saddles being mounted to the bottom side of a container in two different arrangement for receiving two different weapons, all in accordance with the present invention.

Other embodiments of lower saddle 40 may utilize different sizes and shapes so long as a concave profile permits secure placement of a weapon therein. Referring to FIG. 8, for example, bed 60 of lower saddle 40 may be configured as shown. The taper between inner surfaces 58 from dimension A to dimension C, where A=1.505 inches and C=1.874 inches, fits most rifle stocks, whereas dimension C alone specifically fits M249SAW machine guns and M2HB rifle barrels.

Located proximate second end 54 is a mount 62 comprising a molded hook 64 and molded pass-through hole 66. Hook 64 and hole 66 permit a shock cord to be affixed to lower saddle 40. Mount 62 also comprises a mount hole 68 extending from top side 42 to the bottom side 44, permitting a bolt (not shown) to be inserted to attach lower saddle 40 to a container (not shown) as described below. Preferably, a flange 70 extends from bottom surface 44 of lower saddle 40. Flange 70 is sized to be inserted into a slot of a slotted shelf, as described below, to restrict lateral movement of lower saddle 40. Of course, flange 70 is not restricted to a particular size and shape, and may be sized and shaped to be inserted into varying slots, detents, or other retaining devices of shelves to restrict movement of lower saddle 40.

Figure 5:
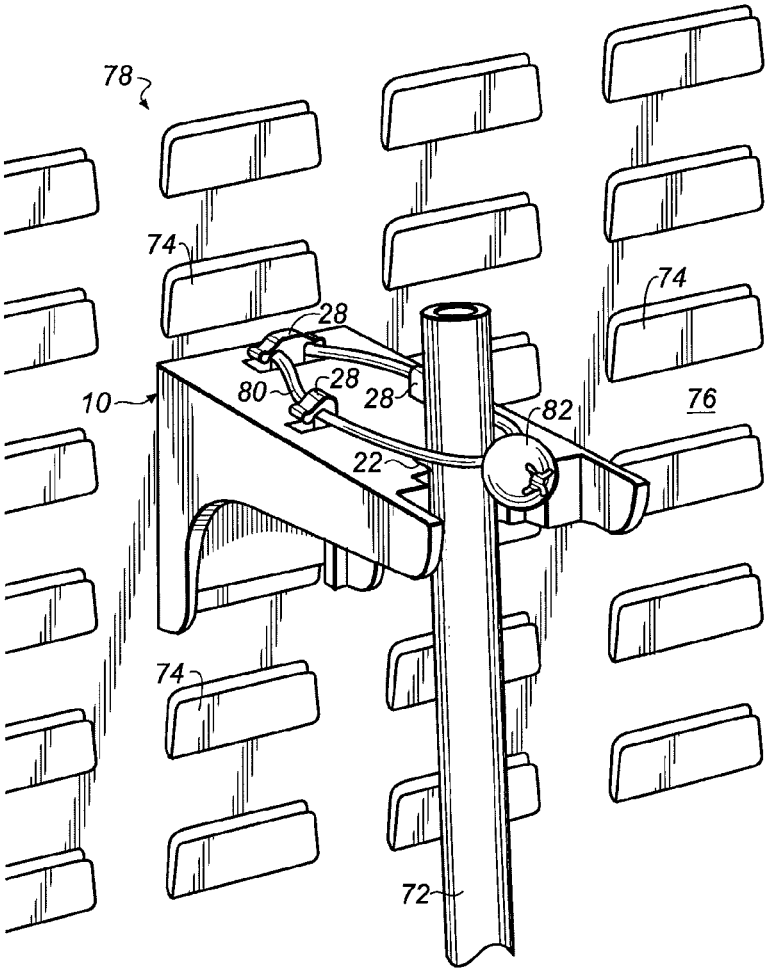
FIG. 5 is an isometric view showing a barrel of a weapon disposed within an inset in an upper saddle and secured thereto by a lanyard, the upper saddle being mounted to a side of a container, all in accordance with the present invention.
Figure 6:
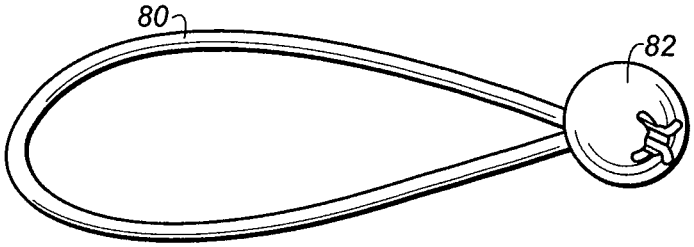
FIG. 6 is an isometric view of the lanyard shown in FIG. 5.

Referring now to FIGS. 5 and 6, a barrel 72 of a weapon (not shown) is disposed in an inner inlet 22 of upper saddle 10 mounted on a bracket (not visible but identical to visible brackets 74) formed in a louvered back 76 of a weapons container 78. Louvered back 76 may be formed, for example, by stamping of sheet metal stock to form brackets 74 integral with back 76. Preferably, barrel 72 is secured and restrained in inner inlet 22 by placement of an elastic lanyard 80 stretched around cleats 28 and barrel 72. Preferably, lanyard 80 includes a graspable bead 82 to facilitate placement and removal of lanyard 80.

Figure 7:
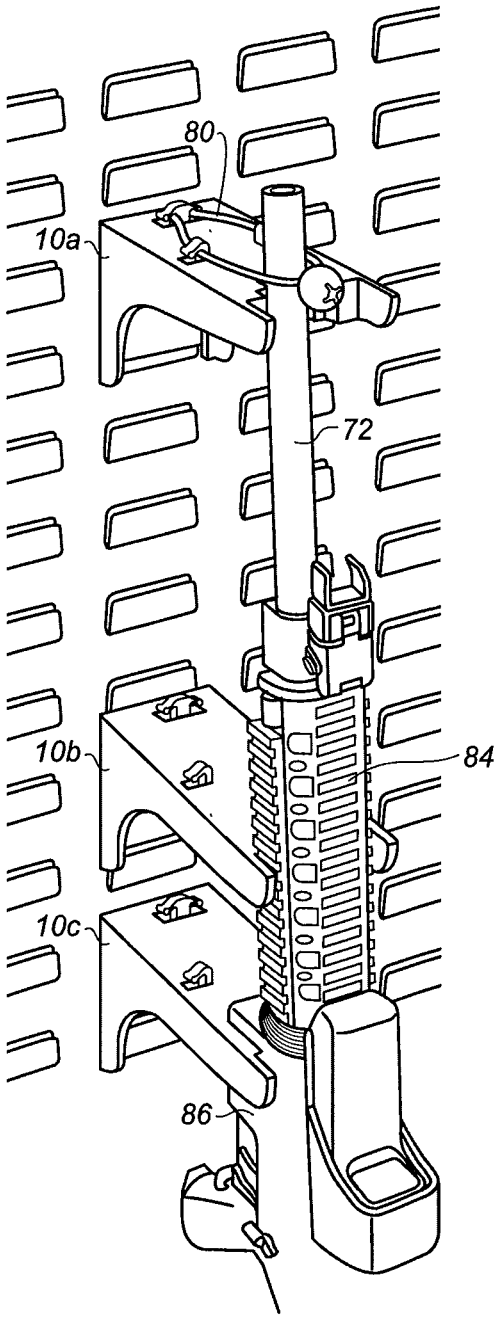
FIG. 7 is an isometric view of a portion of a weapon secured within an arrangement comprising three upper saddles.

Referring to FIG. 7, a weapon storage system in accordance with the present invention may employ a plurality of individual upper saddles 10 to support and restrain various parts of a single weapon. For example, a first upper saddle 10*a* may be employed to support a weapon barrel 72 as just described above with respect to FIG. 5; a second upper saddle 10*b* may be employed with or without upper saddle 10*a* to support the same weapon's picatinny rail 84; and a third upper saddle 10*c* may be employed with or without upper saddles 10*a*,10*b* to support the same weapon's magazine well 86. A lanyard 80 is generally not required for upper saddles 10*b*, 10*c*, as the weapon is restrained by lanyard 80 at upper saddle 10*a*.

Referring to FIG. 8, embodiments of a weapon storage system in accordance with the present invention may comprise a plurality of lower saddles 40 in various combinations. This flexibility is afforded by an arrangement wherein a bottom shelf 88 of a weapon storage and transport container 90 is provided with at least one, and preferably a plurality, of parallel slots 92 for receiving and aligning flange 70 (FIG. 4) of one or more lower saddles 40 in pairs. In each pair, the lower saddles 40 are oriented in opposition so that first ends 52 face each other. Preferably, each lower saddle 70 is secured by means of a carriage bolt 94 disposed in through-hole 68 (FIG. 4). Each slot 92 preferably is provided with an enlargement 96 that allows each carriage bolt head (not visible) to be inserted through shelf 88. Carriage bolts are then secured by wing nuts 98.

Figure 9:
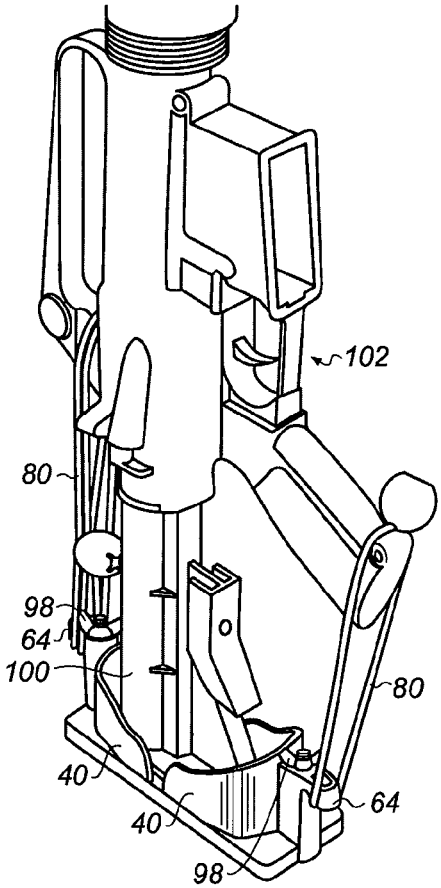
FIG. 9 is an isometric view showing a portion of a weapon without a shoulder stock disposed and secured in an arrangement of two lower saddles, as shown in FIG. 8.

Referring now to FIG. 9, it will be seen that an important practical advantage of the arrangements shown in FIG. 8 is the capability of the system to accommodate a variety of widths of weapon stocks or other components simply by quickly and easily adjusting the distance between the lower saddles 40 in each pair. In operation, a lower saddle pair is preliminarily positioned at approximately the correct spacing apart from each other, the weapon stock or other component 100 is placed in the pair, and then either or both of the lower saddles 40 is moved toward the stock and secured by tightening wing nuts 98 to snugly constrain the stock in the pair.

Further security may be provided by stretching one or more lanyards 80 around convenient elements of the weapon 102 and respective hooks 64 of the lower saddles 40. One of skill in the art will understand the amount of spacing needed between saddles in order to create a configuration necessary to affix a weapon or weapon system to the saddle system.

In a further embodiment (not shown), the contour of each member of a pair of lower saddles 40 may be formed to receive a specific weapon stock or other component.

Figure 10:
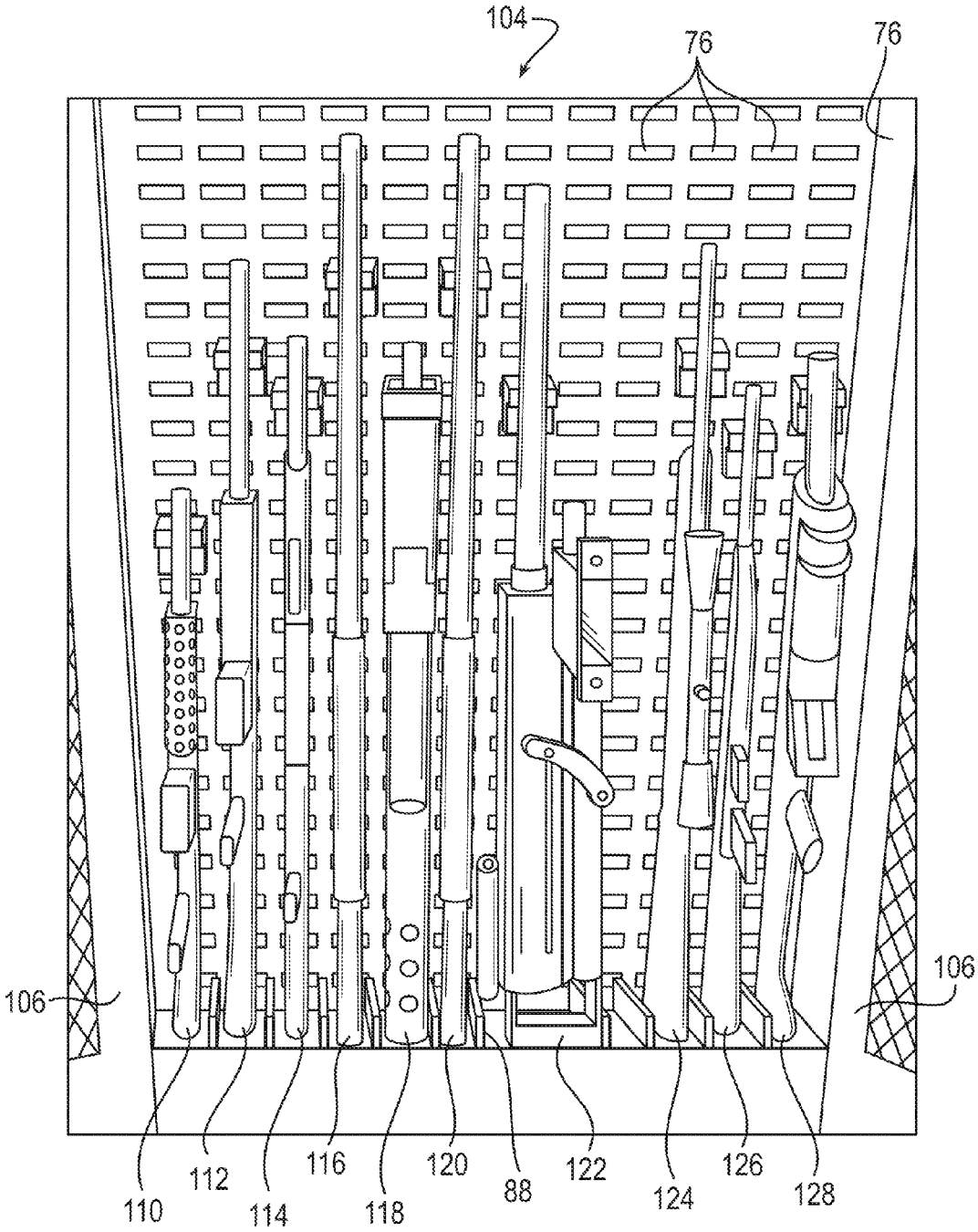
FIG. 10 is a front view of an open container showing a plurality of different kinds of weapons all securely stored within the container in accordance with the present invention.

Referring now to FIG. 10, it will be seen that a further important practical advantage of a weapon storage system in accordance with the present invention is the capability of the system to accommodate a variety of different weapons in a single storage and transport container. For example, a container 104 comprises a louvered back 76 having an array of brackets 74, as shown in FIG. 5, and a bottom shelf 88 as shown in FIG. 8. Container 104 may further comprise one or more hinged and lockable doors 106. By appropriate use of a plurality of upper saddles and lower saddles as described above, a plurality of different types of weapons, for example, weapons 110,112,114,116,118,120,122,124,126,128, may be stored together in a single storage and transport container. Additional combinations of upper and lower saddles may be utilized to create configurations of the saddle system to securely store other types of weapons within a single container 104.

Container 104 preferably comprises a horizontal slotted shelf 88 and a vertical louvered back 76 as just described, although other configurations of shelves and backs may be provided in accordance with the present invention.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for securing a weapon for storage or transport, comprising:

a) an upper saddle having an about forwardly facing inset configured to receive a first portion of said weapon;

b) an elastic lanyard, said upper saddle comprising at least one cleat having at least one outwardly extending tang, said cleat configured to receive said elastic lanyard wrapped around said cleat and captured by said at least one tang, said elastic lanyard configured to wrap around said weapon and to secure said weapon to said upper saddle;

c) a lower saddle configured to receive a second portion of said weapon;

d) said upper saddle configured to engage a bracket formed in a back wall of a storage container; and e) said lower saddle configured to be received by a shelf formed in the storage container such that when said weapon is secured to said upper saddle and is received by said lower saddle said weapon is disposed in an about vertical position.

2. A system in accordance with claim 1 further comprising a storage container having:

a) a back wall configured to receive said upper saddle; and b) a shelf configured to receive said lower saddle.

3. A system in accordance with claim 2 wherein said upper saddle comprises a least one inset for receiving a portion of a weapon.

4. A system in accordance with claim 3 wherein said upper saddle comprises:

a) a first inset for receiving a barrel of a weapon;

b) a second inset for receiving a rail of a weapon; and c) a third inset for receiving a magazine well of a weapon.

5. A system in accordance with claim 2 wherein said system includes:

a) at least one bracket formed in said back wall; and b) at least one flange formed in said upper saddle for engaging said bracket.

6. A system in accordance with claim 2 wherein said lower saddle includes at least one lower flange and wherein said shelf includes at least one slot for receiving said lower flange.

7. A system in accordance with claim 6 wherein said shelf includes a plurality of slots.

8. A system in accordance with claim 1 further comprising a plurality of said upper saddles.

9. A system in accordance with claim 1 further comprising a plurality of said lower saddles.

10. A system in accordance with claim 9 wherein at least some of said lower saddles are arranged in pairs wherein one of said lower saddles is arranged opposite the other of said lower saddles.

11. A system in accordance with claim 10 wherein a spacing between a lower saddle pair is configured to affix a weapon or weapon system to the system.

12. The system for securing a weapon for storage or transport of claim 1, wherein said lower saddle further comprises at least one hook configured to receive an elastic lanyard configured to wrap around said weapon to secure said weapon to said lower saddle.

13. The system for securing a weapon for storage or transport of claim 1, wherein said elastic lanyard further comprises a graspable bead configured to facilitate placement or removal of said elastic lanyard.

14. The system for securing a weapon for storage or transport of claim 1, wherein said upper saddle comprises three cleats configured to receive said lanyard, each of said cleats comprising an outwardly-extending tang.

15. The system for securing a weapon for storage or transport of claim 1, wherein said lanyard is stretched around a barrel of said weapon.

16. The system for securing a weapon for storage or transport of claim 1, wherein said upper saddle is configured to accept a picatinney rail of said weapon.

17. The system for securing a weapon for storage or transport of claim 1, wherein said upper saddle is configured to accept a magazine well of said weapon.

18. The system for securing a weapon for storage or transport of claim 1, wherein said system includes a plurality of upper saddles to support and restrain two or more parts of a single weapon.

* * * * *